United States Patent [19]

Elsner et al.

[11] 4,423,584

[45] Jan. 3, 1984

[54] ROLL-WRAPPING APPARATUS WITH LABEL INSERTER AND METHOD

[75] Inventors: Bertram F. Elsner; Frank Elsner, Jr.; Robert E. Molison, all of Hanover, Pa.

[73] Assignee: Elsner Engineering Works, Inc., Hanover, Pa.

[21] Appl. No.: 234,572

[22] Filed: Feb. 13, 1981

[51] Int. Cl.[3] ..... B65B 11/04; B65B 11/08; B65B 61/20

[52] U.S. Cl. ..... 53/415; 53/399; 53/466; 53/586; 53/137; 53/229; 53/553

[58] Field of Search ..... 53/466, 415, 137, 172, 53/176, 586, 587, 399, 229, 553; 156/484, 485

[56] References Cited

U.S. PATENT DOCUMENTS

| | | | |
|---|---|---|---|
| 893,748 | 7/1908 | McCarty | 53/137 X |
| 1,055,049 | 3/1913 | Keyes | 53/172 X |
| 1,269,969 | 7/1918 | Smith | 53/172 X |
| 1,760,615 | 5/1930 | Wheeler | 53/172 X |
| 1,882,695 | 10/1932 | Aldrich | 53/172 X |
| 2,263,501 | 11/1941 | Jones | 53/157 X |
| 3,041,806 | 7/1962 | Burt | 53/172 |
| 3,207,300 | 9/1965 | Farmer | 206/45.33 |
| 3,621,633 | 11/1971 | Low | 53/586 |
| 3,866,389 | 2/1975 | Elsner | 53/586 X |
| 3,892,057 | 7/1975 | Goode | 53/133 X |
| 3,990,215 | 11/1976 | Elsner et al. | 53/182 R |

FOREIGN PATENT DOCUMENTS

| | | | |
|---|---|---|---|
| 2350307 | 4/1975 | Fed. Rep. of Germany | 53/172 |
| 2423439 | 11/1975 | Fed. Rep. of Germany | 53/553 |

OTHER PUBLICATIONS

Sketch Illustrating Operation of Beck & Co. Roll--Wrapping Machine.

Apparatus Described in Linske Declaration at pp. 2 and 3.

*Primary Examiner*—John Sipos

*Attorney, Agent, or Firm*—Thomas Hooker

[57] ABSTRACT

Apparatus and method for wrapping a roll with a welded closed snug envelope of transparent heat shrink plastic film and a label accurately positioned between the roll and envelope away from the weld bead closing the envelope.

16 Claims, 15 Drawing Figures

ROLL-WRAPPING APPARATUS WITH LABEL INSERTER AND METHOD

The invention relates to apparatus and methods for wrapping transparent heat shrink film around rolls of tightly wound sheet material, such as wrapping paper, and the like with a label accurately positioned between the envelope and roll away from the seal closing the envelope about the roll. In a subsequent conventional operation, the envelope is shrunk onto the roll to hold the label on the roll in the desired location.

In conventional roll-wrapping apparatus, including Elsner et al U.S. Pat. No. 3,990,215, lengths of upper and lower heat shrink film are fed to a work area and are bonded together to form a curtain extending in front of a pair of reciprocal heat seal jaws. When the jaws are opened a roll is moved against the curtain so that the roll and curtain are moved through the open jaws. The jaws then close to form two lateral seals between the sandwiched film material. The downstream seal encloses the film around the roll to form a film envelope and the upstream seal reestablishes the film curtain in front of the jaws. The films are severed between the seals and the jaws are opened to release the roll and envelope for movement away from the jaws and subsequent shrinking of the envelope onto the roll.

One conventional roll-wrapping machine shown in German GM No. 7514758.9 of 1975 inserts labels in the envelope. The machine includes a passive label feed which drops an individual label down a gravity chute to a position immediately upstream of the curtain so that when the roll moves the curtain through the jaws it picks up and carries the label with it. The jaws are opened and the roll gravity falls into the loose curtain formed by advancing both films an equal length. The jaws then close to seal and sever the films, allowing the wrapped roll to drop from the downstream side of the jaws and to re-establish the film curtain.

This wrapping and labeling machine has experienced a number of problems. The labels jam in the gravity chute leading to the pickup position. Jamming of this sort requires shutting down the machine until the chute is cleared. When the sealing jaws are opened, the roll gravity falls through the open jaws into the prefed loose curtain. The shock of this fall sometimes breaks open the curtain seam, making it impossible to wrap and label the roll. With the equal length positive upper and lower film feeds, small roll diameter tolerances, such as the type normally expected in a run of wrapped sheet material, mean that some of the rolls will be too small for the fixed size envelope of unshrunk film, thus allowing the label to move and become misoriented between the envelope and roll. Further, after the envelope is formed the roll is gravity dropped to a support surface prior to shrinking. Dropping tends to dislodge the label from its position.

U.S. Pat. No. 3,289,386 discloses a wrapping machine where a continuous strip of labels is fed on the inner surface of one of the films so that upon sealing and shrinking, the label is visible through the wrap.

In the present invention, a label transfer assembly extends across the roll feed path to pick up a label presented by a label feeder and then retracts below the roll feed path to position the accurately held label immediately upstream of a taut film curtain. A roll is pushed downstream against the label and taut curtain and through the open sealing jaws to a held position just beyond the jaws. While the roll is moved through the open sealing jaws to a held position on a discharge conveyor, a measured length of film is fed to one side of the curtain on the roll and then sufficient film is fed from the other length of film to complete the wrap around the roll. The curtain is maintained taut during feeding. Closing of the sealing jaws forms a snug envelope of transparent sealing film surrounding the roll and accurately located label, regardless of variations in roll diameter.

The length of film positively fed to the work area during movement of the roll through the jaws controls the net rotation of the roll prior to deposit of the roll on the discharge conveyor. The apparatus may be adjusted to provide clockwise net rotation, counterclockwise net rotation or no net rotation, depending upon the position of the label when initially picked up by the roll and the position of the weld bead closing the envelope. In this way, a snug envelope is formed around the roll and label and the circumferential edges of the label do not extend into the sealing jaws and interrupt either the weld bead closing the envelope around the roll or the upstream welded bead reforming the taut film curtain.

Other objects and features of the invention will become apparent as the description proceeds, especially when taken in conjunction with the accompanying drawings illustrating the invention, of which there are six sheets and one embodiment.

IN THE DRAWINGS

Figure 5:
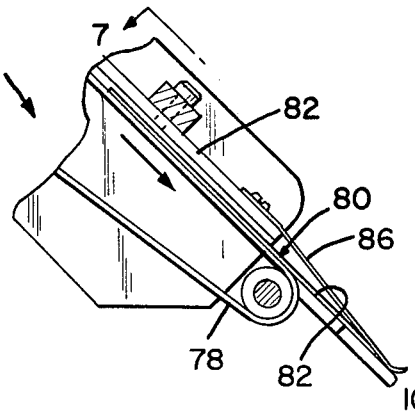
FIGS. 5 and 6 are enlarged views illustrating the pickup of a label by the transfer assembly from the label feeder.
Figure 6:
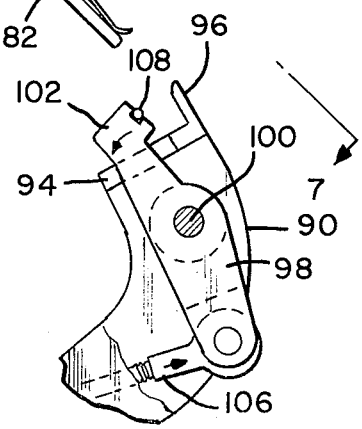
Figure 6:
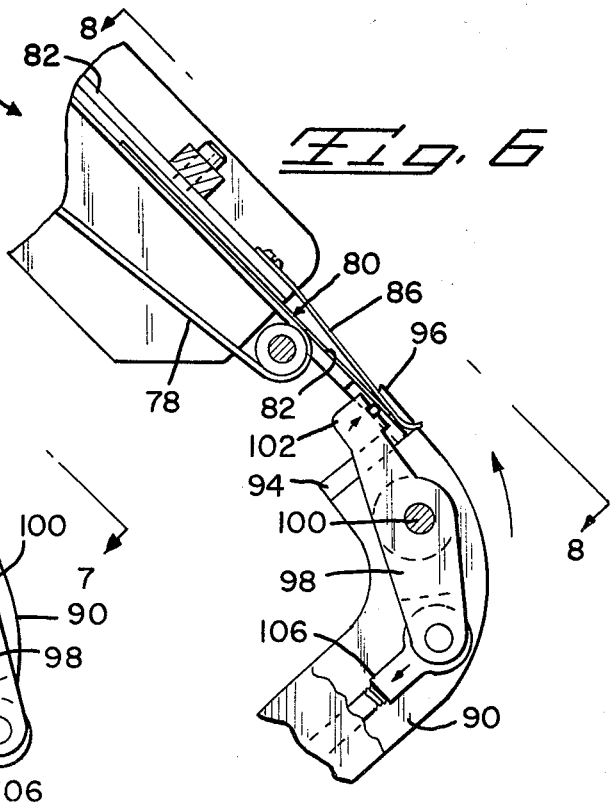
Figure 7:
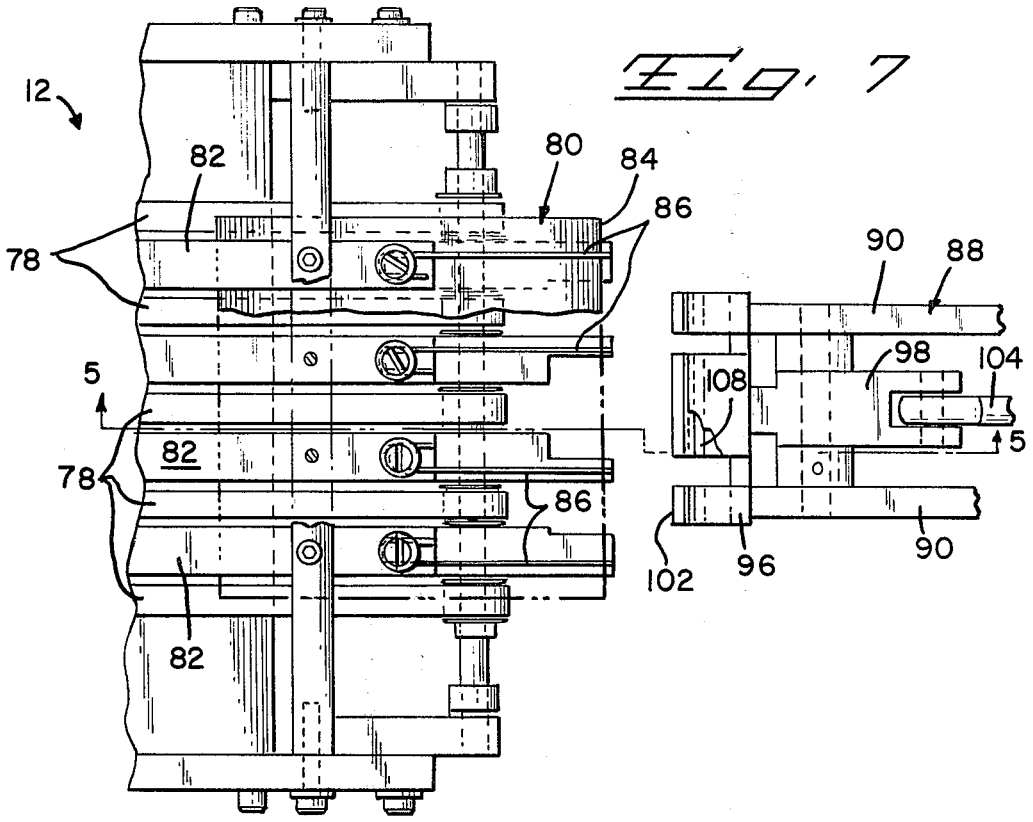
Figure 8:
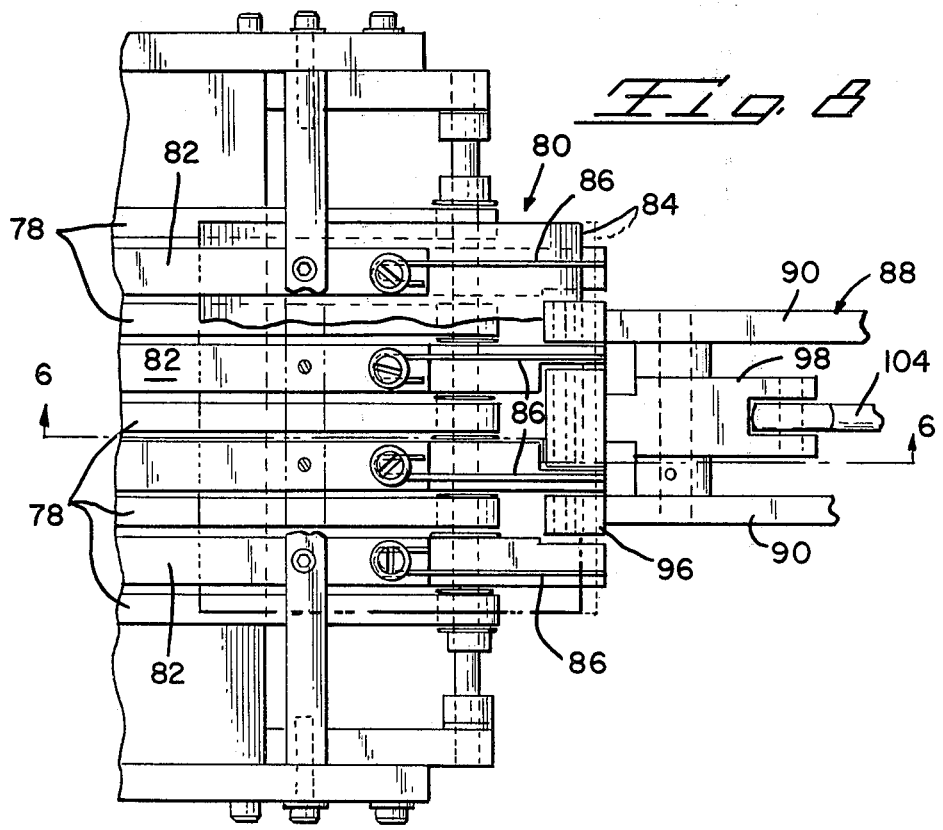
Figure 13:
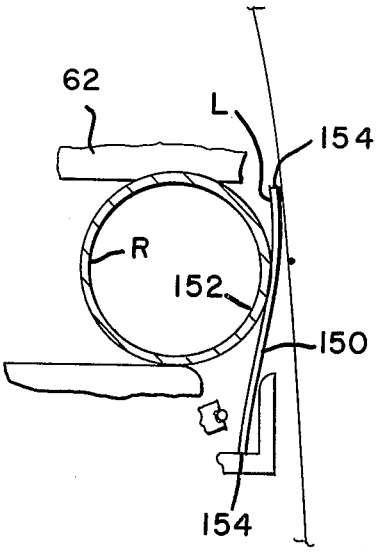
Figure 14:
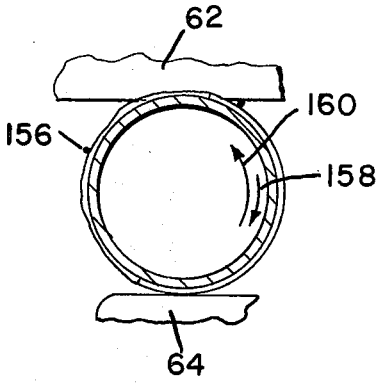
Figure 15:
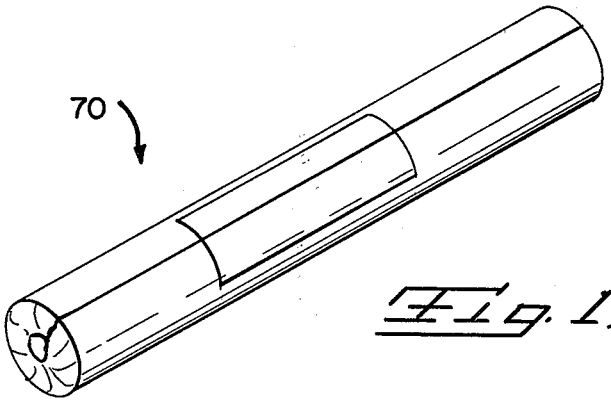

FIGS. 7 and 8 are views taken along lines 7—7 and 8—8 of FIGS. 5 and 6 respectively;

FIGS. 9 and 10, 11 and 12 and 13 and 14 are enlarged views illustrating wrapping of different sized rolls with different sized labels; and FIG. 15 is a perspective view of a sealed roll, with a label in place.

Apparatus 10, as illustrated in FIGS. 1 through 4, is a modification of a conventional roll wrapping apparatus of the type shown in Elsner et al U.S. Pat. No. 3,990,215 with a label feeder 12 and label transfer assembly 14. The apparatus includes a roll infeed conveyor 16, a film feed 18 located at the downstream end of the conveyor 16, a pair of reciprocating sealing jaws 20 and 22 adjacent the film feed and a roll discharge conveyor 24 downstream from the sealing jaws. The roll infeed conveyor 16 includes a series of laterally spaced support rails 26, only one of which is illustrated in the drawings, with a number of conveyor belts 28 moving downstream along the top of the rails, around pulleys 30 and upstream along the bottom of the rails. The belts are continuously driven by conventional drive means. A pair of resilient roll hold-downs 32, only one of which is illustrated in the drawings, are mounted on support plates 34 a distance above the upper runs of conveyor belts 28.

Tightly coiled rolls R of sheet material are fed to the upstream end of the infeed conveyor 16 at regular intervals. The rolls are confined between the upper runs of belts 28 and the resilient hold-downs 32 so that the downstream movement of the conveyor belts rotates the rolls about the hold-downs and feeds the rolls downstream toward the sealing jaws.

The film feed assembly 18 supplies transparent plastic heat shrink film to the work area 34 adjacent the sealing jaws from upper and lower rolls of film (not illustrated). The upper film 36 extends from the upper roll around a guide roller 38, through an incremental film feed 40, around a vertically moveable dancer bar 42 and thence around guide roller 44 and bar 46 to the work area where it joins the end of the lower film 48 at weld bead 50.

The lower film 48 extends from the lower supply roll through a demand film feed 52, around guide roller 54 and dancer bar 56 and past guide bars 58 to the bead 50. The joined upper and lower films form a curtain extending across the work area 34 adjacent conveyor 16. The curtain is maintained taut by the weight of dancer bar 42.

The film feed 40 supplies a measured amount of film to be fed to the work area to wrap each roll. The lower film 48 is fed to the work area 34, according to need. Dancer bar 56 is heavier than dancer bar 42 so that during wrapping the measured length of upper film 36 is first drawn into the work area and dancer bar 42 is raised from a lower position shown in FIG. 1 up to the upper stop position 60. Following exhaustion of the available upper film, lower film is fed into the work area and the heavier dancer bar 56 is raised from its rest position shown in FIG. 1. Initial raising of the bar 56 trips a microswitch to actuate feed 52 to supply additional lower film from the supply roll until bar 56 has returned to the rest position and no further lower film is required to complete the wrapping operation.

The upper and lower sealing jaws are of conventional design. When the jaws close about a double thickness layer of heat seal film, two closely spaced lateral welds or beads are formed between the films and the films are then severed between the beads. The apparatus 10 includes conventional drives for raising and lowering the jaws, forming the beads and severing the film after the formation of the beads.

The roll discharge conveyor 24 includes resilient upper roll hold-downs 62, similar to hold-downs 32 on the infeed conveyor, a roll support platform 64 adjacent the jaws 20 and 22 and a number of continuously driven conveyor belts 66 having upper runs extending in a downstream direction. The belts 66 are wrapped around pulleys 68 adjacent the work area. Pulleys 68 move from the lower position of FIG. 1 to the raised position of FIG. 4 for conveying a wrapped roll with label downstream from the work area to a conventional heat shrink station. At this station, the sealed film envelope surrounding the roll and label is shrunk against the roll to form package 70 shown in FIG. 15.

The apparatus 10 includes a pair of laterally spaced roll pusher bars 72, although only one bar is illustrated. The bars are moveable between infeed conveyor support rails 26 from a retracted position shown in full line in FIG. 1 and a fully extended position shown in FIG. 2. The pusher bars carry V-shaped roll-engaging heads 74 which engage rolls on infeed conveyor platform 76, move the rolls through the work zone past the sealing jaws 20 and 22 as illustrated in FIG. 2 and deliver the rolls to the discharge conveyor between platform 64 and hold-downs 62. The pusher bars are moved between the retracted and extended positions by a conventional drive.

Label feeder 12 is mounted on apparatus 10 above the infeed conveyor 16 slightly upstream of the work area 34. The feeder includes a supply of individual rectangular paper labels and a label feed including belts 78 for moving individual labels 80 along feed surface 82 until the label reaches a pickup position shown in FIG. 7 with the lead label edge 84 engaging nip wires 86. See FIG. 5.

Label transfer assembly 14 is mounted on apparatus 10 between adjacent infeed conveyor support rails 26 away from pusher bars 72 and includes a pivot arm 88 comprising a pair of spaced side plates 90 pivotally mounted at their upstream ends to a shaft 92 on apparatus 10. Plate 94 extends between the downstream ends of side plates 90 and includes a fixed upstanding jaw member 96 on the downstream side thereof. Pivot finger 98 is rotatably mounted on shaft 100 extending between the downstream ends of plates 90 and includes an elongated slotted gripping jaw member 102 coextensive with fixed jaw member 96.

Pivot arm 88 carries a jaw air cylinder 104 located between plates 90 with the fixed end of the cylinder pivotally mounted on a shaft extending between the plates on the upstream end of the pivot arm and an air cylinder piston rod 106 pivotally mounted to the lower end of finger 98. Extension of air cylinder 104 opens jaw 96, 102 as illustrated in FIG. 5 and retraction of the air cylinder closes the jaw as shown in FIG. 6. A resilient grip strip 108 extends along the grip surface of jaw member 102.

The transfer assembly includes a pivot arm air cylinder 110 having a fixed end pivotally mounted to apparatus frame member 112 and a piston rod 114 pivotally mounted to ears 116' extending from the lower sides of plates 90. When cylinder 110 is retracted the pivot arm 88 is retracted in the position shown in FIG. 1 below the upper run of the infeed conveyor. Extension of cylinder 110 pivots the arm 88 above the infeed conveyors so that the open jaw 96, 102 surrounds the lead edge of label 80 on label feeder 12.

The operation of the roll wrapping and label inserting apparatus 10 will now be described in detail.

Tightly coiled rolls of sheet material R are supplied to the infeed conveyor 16 and are moved downstream along the conveyor at spaced intervals. The interval is indicated by the spacing between the rolls shown in dotted lines at positions 116 and 118 of FIG. 1. The cycle of operation apparatus 10 will be described beginning with a roll at initial position 120 as shown in FIG. 1 and continuing until the adjacent upstream roll has moved downstream to position 120.

Figure 1:
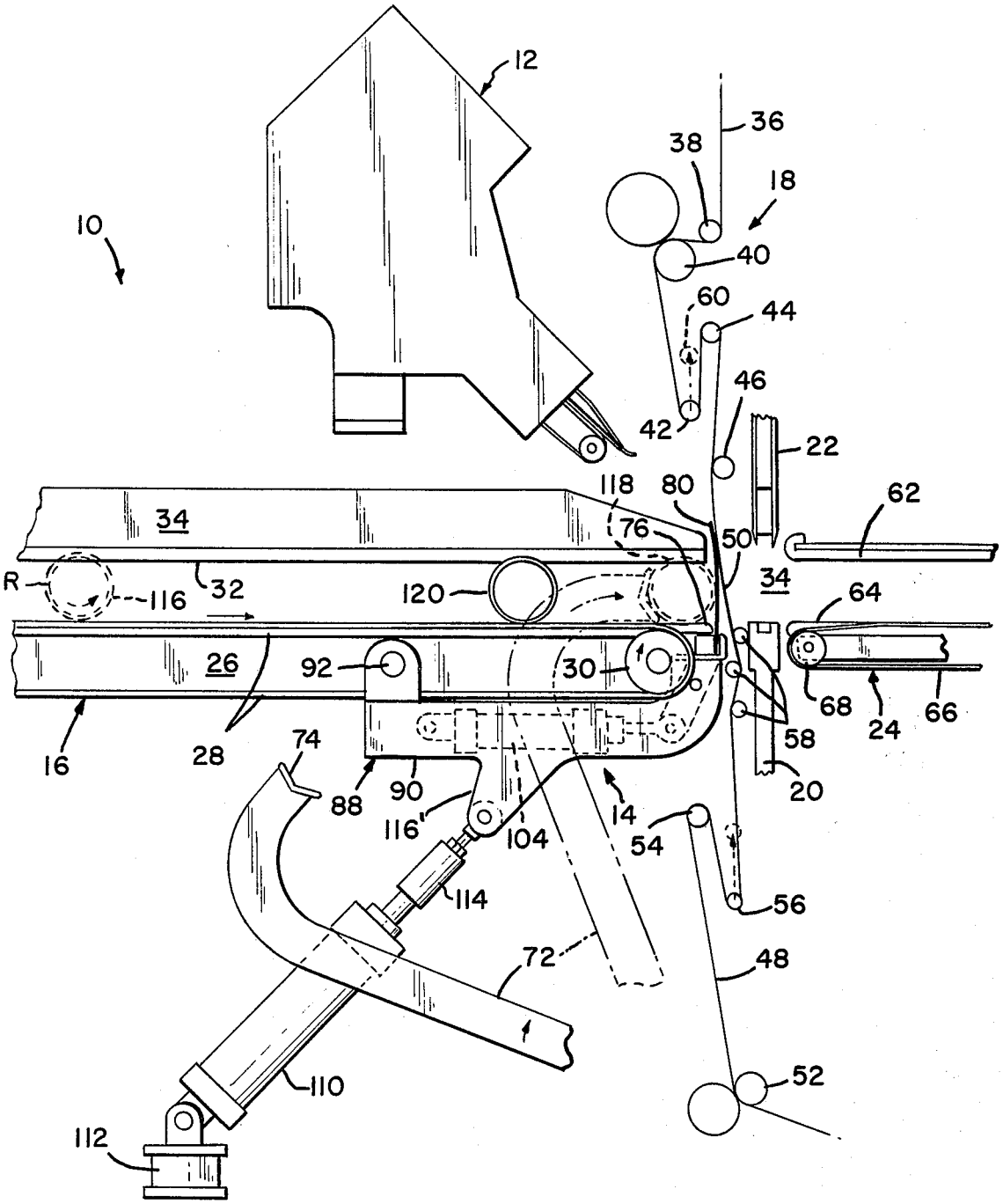
FIG. 1 is a generalized sectional view taken through a roll-wrapping apparatus illustrating the infeed and discharge conveyors, the sealing jaws, the roll pusher bars, the label feeder and the label transfer assembly.
Figure 2:
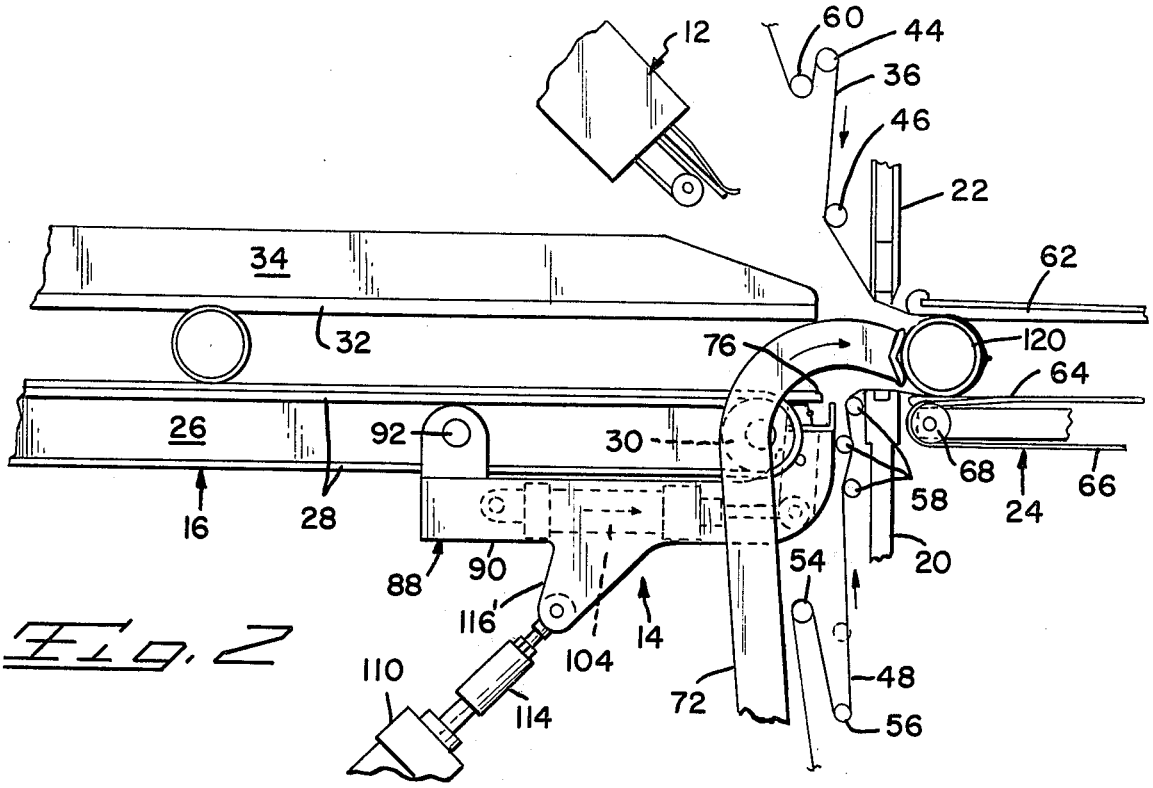
FIGS. 2, 3 and 4 are similar to FIG. 1 illustrating the operation of the apparatus.
Figure 3:
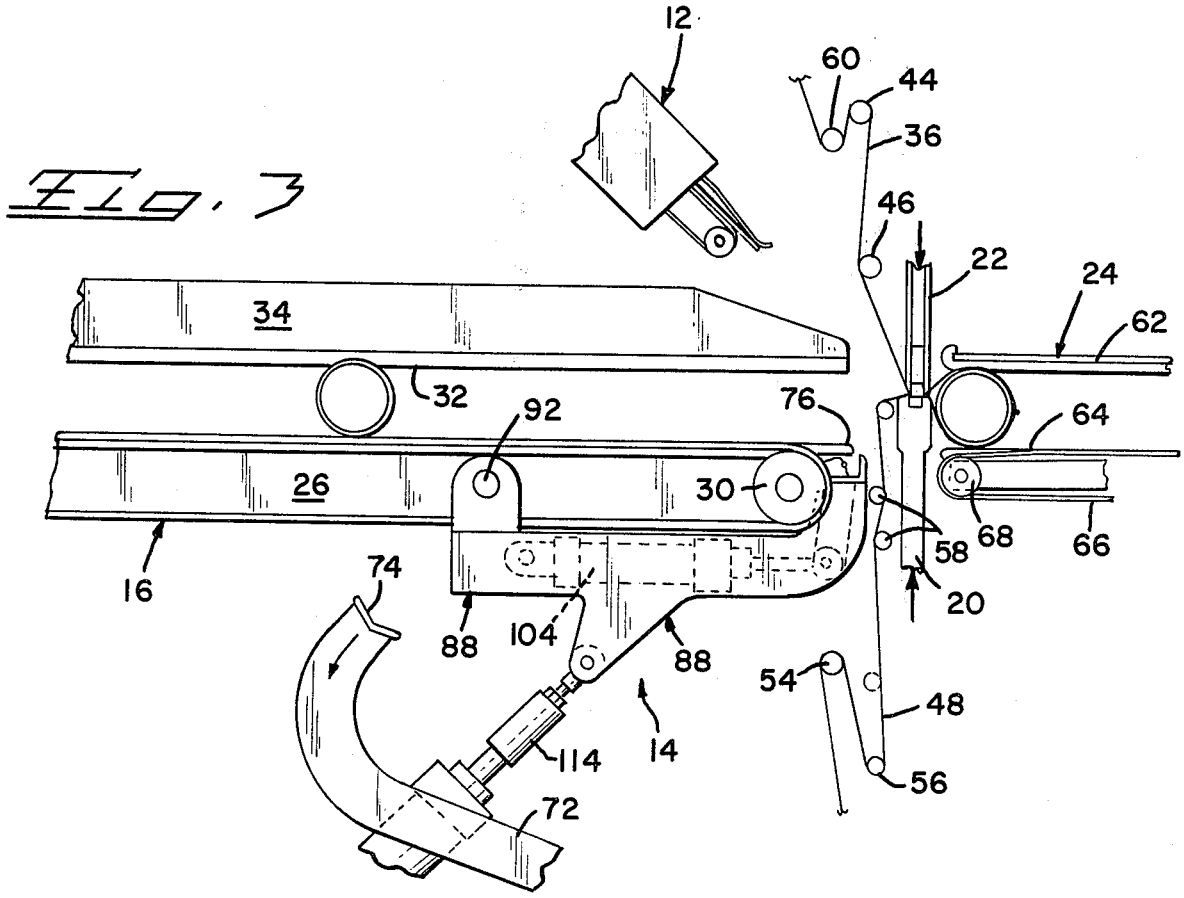

At the beginning of the cycle of operation the apparatus 10 is in the position shown in FIG. 1 with the pusher bars 72 withdrawn, pivot arm 88 in the retracted position with a label 80 held clamped between closed jaw members 96 and 102 and extending upwardly from the jaw across the work area 34 immediately upstream of the taut film curtain. Sealing jaws 20 and 22 are open and the discharge conveyor pulleys 68 are lowered.

Movement of the roll to position 120 trips a microswitch to actuate upper film feed 40 to feed a measured length of upper film 36 from the supply reel. Feeding of the upper film allows the upper dancer bar 42 to lower from the raised position 60 to the position illustrated in FIG. 1. The weight of the upper dancer bar maintains tension in the film curtain extending across the work area. Closing of the microswitch also actuates the label feeder 12 to feed the next label 80 to the pickup position illustrated in FIG. 7 where lead edge 84 engages nip wires 86.

As the roll is moved near platform 76, air cylinder 104 is extended to open the label gripping jaw thereby releasing the label to be picked up by the roll.

Upon completion of the upper film feed, a microswitch is tripped to actuate the pusher bar drive thereby rotating the pusher bars upwardly from the solid line position illustrated in FIG. 1 so that the heads 74 engage the upstream side of the roll after conveyor belt 28 moves the roll onto platform 76. Further downstream movement of the pusher bars forces the roll against the freed label and taut film curtain and pushes the roll, label and curtain through the sealing jaws 20 and 22 as illustrated in FIG. 2.

Initial engagement between the pusher bars and the roll on platform 76 slides the roll downstream from the platform and resilient hold-downs 32 without rotation. As the roll is transferred downstream, the taut film is wrapped around either side of the roll to form relatively large area high-friction contact with the roll by the time the roll is free of the platfrom and hold-downs. The label is sandwiched between the roll and the film curtain in proper position and orientation on the roll with the top and bottom edges of the label parallel to the roll axis.

During initial feeding of the roll against the film curtain, the lighter upper dancer bar 42 is raised, the heavier lower dancer bar 56 is unmoved and the prefeed measured length of the upper film is fed to the work area. Lower dancer bar 56 is raised and lower film 48 is fed to the work area on demand only after all of the available upper film has been exhausted and the lighter upper dancer bar 42 has been raised to its uppermost position 60.

After the roll has been pushed past the sealing jaws as shown in FIG. 2 and is held between platform 64 and holddowns 62, the pusher bars are retracted to the solid-line position of FIG. 1. When the pusher bars are free of the sealing jaws, a microswitch is actuated to close and actuate the sealing jaws, thereby forming weld beads between the trapped upper and lower films on either side of the jaws and severing the film between the beads. The downstream bead seals together the films to form a snug film envelope surrounding the roll and the accurately positioned label. The upstream bead rejoins the upper and lower films so that upon opening of the jaws the weight of the upper dancer bar re-establishes the taut curtain extending across work area 34.

Figure 4:
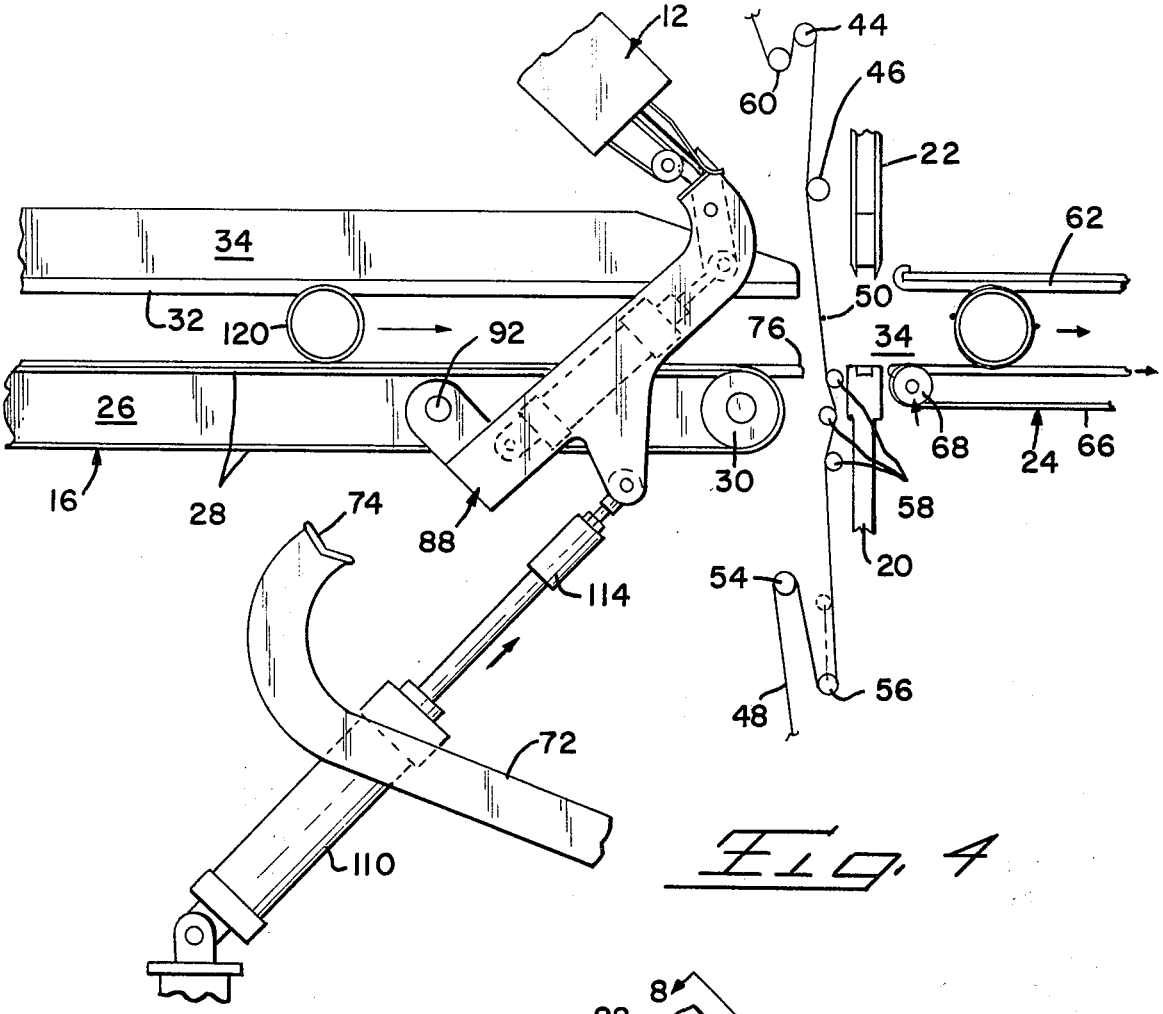

During or following actuation of the sealing jaws 20 and 22, pivot arm cylinder arm 110 is extended to raise the pivot arm 88 to the extended position of FIG. 4. As the pivot arm nears the extended position, as illustrated in FIGS. 5 and 7, the open jaw 96, 102 extends past the downstream edge 84 of presented label 80 and plate 94 engages the label edge 84 and lifts the label up a slight distance from the nip wires to assure the edge 84 rests flush on plate 94. Air cylinder 104 is then retracted to close the jaw and resiliently clamp the label with edge 84 square on plate 94. Following clamping, cylinder 110 is retracted to lower the pivot arm back to the position of FIG. 1, thereby drawing the clamped label from beneath the nip wires and out of the label feeder. When the cylinder is fully retracted, the clamped label is positioned immediately upstream of the newly formed taut film curtain.

The two pusher bars 72 are preferably extended in spaces between support rails 26 to either side of the label transfer assembly 14. In this way, both the bars and transfer assembly may extend through the feed path at the same time and the machine may be adjusted for optimum rapid cycling.

Following opening of the sealing jaws, the discharge conveyor pulleys 68 are raised so that discharge conveyor belts 66 engage the wrapped and labeled roll and carry the roll downstream away from the work area to a conventional heat shrink station where the snug film envelope is shrunk tightly onto the roll. During movement of the roll along the discharge conveyor, engagement between the roll and the conveyor belt and resilient hold-downs 62 prevents relative movement of the label with respect to the roll and assures the label is retained in proper position on the roll until the film envelope is shrunk onto the roll to positively hold the label in place.

By the time the pivot arm has returned to the retracted position of FIG. 1 and the lead roll has been delivered to the roll discharge conveyor 24, the cycle of operation has been completed and the roll infeed conveyor 16 has moved the next upstream roll to position 120.

In order to seal the film properly along the entire width of the film envelope, it is necessary to prevent the label from being captured between the sealing jaws as they close. Labels are conventionally formed of paper. If captured between the upper and lower plastic films during sealing, the labels act as insulators and prevent bonding of the film to form continuous beads along the envelope. In the event a label extends completely across the sealing jaws, it would disrupt the bead forming the film curtain. Rolls wrapped with improperly sealed envelopes must be discarded.

Apparatus 10 avoids these problems by controlling the amount of upper film fed to the work area and thereby controlling net rotation of the roll during movement between the infeed and discharge conveyors. The upper film feed 40 is adjusted according to the size of the roll and the length of the label to assure that when the sealing jaws are closed the circumferential label edges are approximately equidistant from the upstream weld closing the envelope. Depending upon the particular roll and label configuration, the net rotation of the roll between the infeed and discharge conveyors may be clockwise or counterclockwise. In some applications the roll is moved between the conveyors without any net rotation.

Figure 9:
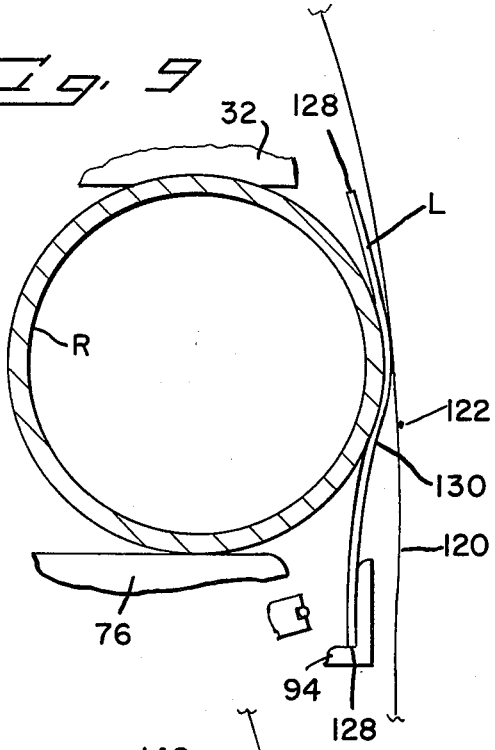
Figure 10:
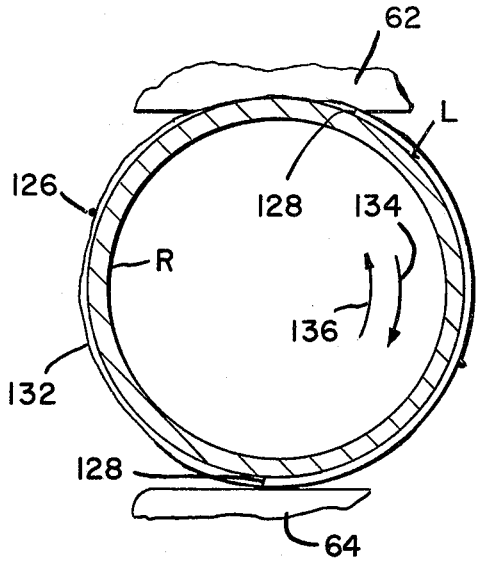

FIG. 9 illustrates a roll R positioned on platform 76 as the roll is moved forward by the pusher bars to engage label L and the taut film curtain 120. The curtain includes a bead 122 formed during packaging of the immediate downstream roll. During initial movement of the roll into the work area the frictional engagement between the roll and platform 76 and hold-down 32 prevent rotation of the roll. When the pusher bars move the roll free of the platform and hold-downs, the lead roll edge has been moved against the label and the taut film curtain 120 to sandwich the film firmly there between and form a relatively large area contact between the curtain and the roll. In the present application, the width of the film is greater than the length of the roll and apparatus 10 forms a full-length film envelope surrounding the roll. In other applications, the width of the film may be less than the length of the roll and forms a tightly fitting band surrounding a portion of the roll with the label held in place under the band.

In FIG. 9, circumferential label ends 128 are equidistant from label midpoint 130, located at approximately the 4 o'clock position of the roll as the roll is pushed from the infeed conveyor. The sealing jaws form the upstream bead 126 closing the envelope at the approximately diametrically opposed 10 o'clock position on the roll when the roll is held on the discharge conveyor. Thus, in order to assure the label ends 128 are approximately equidistant from the weld bead 126, the roll must not be subjected to any net rotation as it is moved between the conveyors and the film is wrapped around the label and roll.

When the roll is free of the infeed conveyor platform and hold-downs, the frictional engagement between the roll and the film is greater than the frictional engagement between the roll and the pusher bar heads 74 so that the roll rotates in the V-shaped heads as it is moved across the work area in response to the film fed to the work area. The nature of the rotation is controlled by the amount of the film made available for feed into the work area from the positive upper film feed 40. After the available upper film is exhausted during initial movement of the roll into the work area, the on-demand lower film feed 52 supplies the remaining film required to complete the roll envelope and re-establishment of the film curtain.

In FIG. 9, the upper and lower film feeds are approximately equal so that during movement of the roll from the infeed conveyor to the discharge conveyor, the roll, as illustrated, rotates first in a clockwise direction through an angle represented by arrow 134 during feeding of the upper film to the work area and then rotates counterclockwise through an equal angle represented by arrow 136 as the demand lower film feed 52 supplies the film necessary to complete the film envelope.

The amount of film supplied by the demand lower film may vary slightly because of slight diameter variations in the rolls due to different embossings on the paper wound on the roll, different paper patterns, the tightness of the wind and other factors. The demand film feed for the lower film assures that despite these variations, a snug envelope is formed around the roll so that, when shrunk, the envelope closely wraps the roll and holds the label in place.

Figure 11:
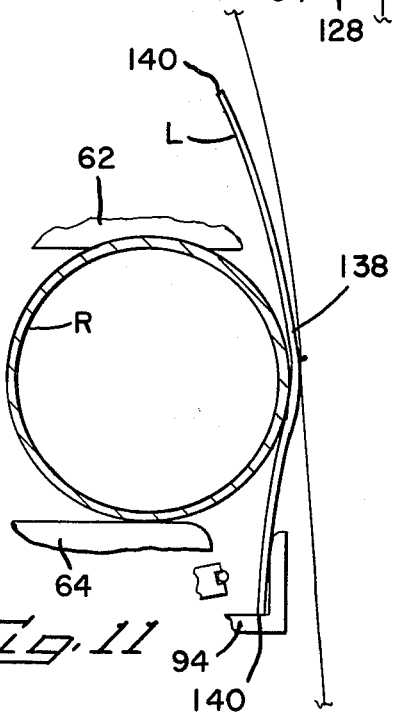
Figure 12:
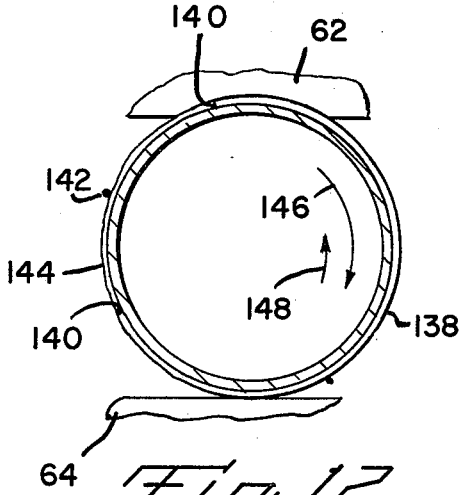

FIGS. 11 and 12 illustrate wrapping a film envelope around a roll and label where the midpoint 138 of label L is above the 4 o'clock position of roll R. In this case, in order to assure that the label edges 140 are equally spaced from envelope bead 142, it is necessary for the roll R to have a net clockwise rotation as it passes through the work area. This is accomplished by adjusting the upper film feed 40 to supply more than one-half of the film needed to form envelope 144. As the roll moves across the work area film is first supplied to the work area from the upper film feed to rotate the roll clockwise through an angle indicated by arrow 146. When the upper film supply is exhausted, the remainig film required to complete the envelope 144 is supplied by the demand lower film and the roll is rotated in a counterclockwise direction through an angle indicated by arrow 148, less than the clockwise rotation. The result of these rotations is that when the roll and label are positioned in the discharge conveyor between platform 64 and hold-down 62, as shown in FIG. 12, they have been rotated through a net angle sufficient to move the label midpoint 138 to the 4 o'clock position approximately diametrically opposite from the bead 142 formed by the sealing jaws during closing of envelope 144. The label edges 140 are approximately equidistant from bead 142.

FIGS. 13 and 14 are similar to FIGS. 9 and 10 and 11 and 12. FIG. 13 illustrates a roll R with a label L having a midpoint 150 located below the 4 o'clock position 152. In order to assure the label is wrapped in an envelope with edges 154 about equidistant from the envelope closing bead 156, the upper film feed is adjusted to provide a length of film less than one-half the amount needed to form the envelope and the lower film feed supplies film required to complete the envelope. As the roll passes the work area, it first rotates in a clockwise direction through an angle indicated by arrow 158 and then in a counterclockwise direction through a larger angle indicated by arrow 160, with the result that when the roll and label are positioned in the discharge conveyor, the roll has been rotated through a net angle counterclockwise and the label midpoint 150 has been moved counterclockwise to the 4 o'clock position, diametrically opposed from bead 156. In the envelope the ends of the label are about equally spaced from the bead.

If desired, the upper film feed may be adjusted to locate one edge of a given label closer to the envelope-forming bead, provided the distance between the edge and the bead is sufficient to prevent the label from being captured between the sealing jaws due to the slight differences in roll diameter and other variations inherent in the roll-wrapping process.

The closing position for the sealing jaws may be adjusted up or down relative to the roll on the discharge conveyor so the envelope-forming bead need not be located at the 10 o'clock or any other particular location. Given the location of the bead for a particular setup, it is an easy matter to adjust the upper film feed so that the labels are positioned as desired in the envelope.

Apparatus 10 may be used to wrap and label cylinders and articles other than tightly wound rolls of sheet material. Accordingly, while we have illustrated and described a preferred embodiment of our invention, it is understood that this is capable of modification, and we therefore do not wish to be limited to the precise details set forth, but desire to avail ourselves of such changes and alterations as fall within the purview of the following claims.

We claim:

1. Roll-wrapping apparatus for forming a package having a roll, a snug transparent film envelope surrounding the roll and a flexible non-rigid label sandwiched between the roll and envelope in a desired position, the label having a circumferential extent on the roll less than the circumference of the roll, the apparatus including an infeed conveyor for moving a roll along a path to a work area; film sealing means in the work area adjacent the end of the infeed conveyor path; film feed means including a positive film feed means on one side of the work area for supplying a pre-measured length of film to the work area for each envelope, a demand film feed on the opposite side of the work area for supplying a sufficient length of film to the work area after the supplying of the pre-measured length of film to complete the envelope surrounding the roll, and tensioning means including first film tensioning means for maintaining tension in the pre-measured length of film and second film tensioning means for maintaining tension in the demand length of film, whereby the roll frictionally engages the curtain; roll pushing means for moving a roll from the end of the infeed conveyor path through the work area so that the roll picks up and carries the curtain through the sealing means whereby as the roll is pushed into the label and curtain it first draws the pre-measured length of film into the work area and due to its frictional engagement with the curtain the roll is first rotated in one direction and then the roll draws the demand length of film into the work area and due to the frictional engagement is rotated in the opposite direction and closing of the sealing means welds the confined film layers together to form a snug film envelope surrounding the roll, re-establishes the curtain and severs the envelope from the curtain; a feeder for flexible non-rigid labels mounted on the apparatus to one side of the path and upstream from the film curtain operable to move labels successively to a pickup position; and a label transfer assembly on the apparatus having a label gripper movable between a first position adjacent the end of the infeed conveyor and immediately upstream of the film curtain and a second position adjacent the label feeder whereby the gripper is operable to engage a flexible label at the label pickup position when in the second position and carry the label to a position immediately upstream of the taut film curtain and in the path of movement of the roll from the infeed conveyor into the work area when the gripper is moved to the first position so that movement of the roll into the work area captures the label between the roll and taut curtain, removes the label from the gripper, folds the label around the roll and then sandwiches the label between the roll and the envelope in a known position.

2. Apparatus as in claim 1 wherein said first position is on the opposite side of the infeed means from said label feeder.

3. Apparatus as in claim 2 wherein the label transfer assembly includes a label gripping jaw, drive means to open and close the jaw and an assembly drive operable to move the jaw from said first position across the infeed means to said second position and back whereby when the label transfer assembly is moved to the second position the open jaws are moved over an edge of the label presented by the label feeder and are then closed to secure the label to the transfer assembly and withdraw the label to the work area.

4. Apparatus as in claim 3 including an opening in the infeed conveyor adjacent the work area, said assembly drive moving through said opening as the jaw moves between the first and second positions.

5. Apparatus as in claim 4 wherein the opening comprises a slot in the infeed conveyor, said label transfer assembly includes an arm pivotedly mounted on the apparatus and said assembly drive rotates the arm through the slot as the jaw moves between the first and second positions.

6. Apparatus as in claim 5 wherein said slot is open ended at the work area and extends directly upstream therefrom and said arm is pivoted mounted on the apparatus away from the work area.

7. The method of forming a package having a roll, a snug transparent film envelope surrounding the roll and a flexible non-rigid label sandwiched between the roll and envelope, the label having a circumferential extent less than the circumference of the roll, comprising the steps of:

a. Establishing a taut transparent film curtain;

b. Feeding a roll along a path toward the film curtain;

c. Presenting a flexible non-rigid label at a gripper pickup position to one side of the path;

d. Positively securing the presented label in a gripper at the pickup position;

e. Moving the gripper from the gripper pickup position toward the path to move the secured label to a roll pickup position extending across the path immediately upstream of the film curtain;

f. Releasing the label from the gripper for pickup by the roll while supporting the label in the roll pickup position;

g. Moving the roll against the label and curtain to remove the label from the gripper, form a frictional connection between the roll and curtain, fold the label and curtain over the roll, sandwich the label between the roll and folded curtain so that the label conforms to the surface of the roll and is held in place in a known circumferential location on the roll between the roll and curtain;

h. Supplying a pre-measured length of film to one side of the curtain to rotate the roll and label in a first direction by said frictional connection and then supplying sufficient demand length film to the other side of the curtain to rotate the roll and label in the opposite direction by said frictional connection and supply sufficient film to the curtain to complete the envelope; and i. Actuating the film seal means upstream of the roll to seal the film surrounding the roll, form a snug envelope, retain the label in the known position, reform the curtain and sever the envelope from the reformed curtain.

8. The method of claim 7 including the steps of securing the lead edge of the label in the gripper and moving the gripper from the gripper pickup position across the path to the roll pickup position so that the body of the label extends from the gripper into the path immediately upstream of the film curtain.

9. The method of claim 7 including the step of imparting zero net rotation to the roll during film feeding.

10. The method of claim 7 including the step of imparting net rotation to the roll in one direction during film feeding.

11. Apparatus for forming a snug transparent film envelope surrounding a roll with a flexible non-rigid label sandwiched between the roll and the envelope, the label having a circumferential extent less than the circumference of the roll, the apparatus including a work area, a positive film feed on one side of the work area for supplying a pre-measured length of film to a curtain extending across the work area, a demand film feed on the opposite side of the work area for supplying film to the other side of the curtain on demand, a label gripper, a drive for moving the label gripper from a label pickup position remote from the work area to a label release position adjacent the curtain so that the gripper engages a flexible non-rigid label at the pickup position and carries the label to a position in front of the curtain in the path of the roll, and means for moving a roll located in front of the curtain against the label and curtain to wrap the curtain over the roll, fold the label over the roll so as to sandwich the label between the curtain and roll and form a frictional connection there between with the label extending partially around the roll and move the roll, curtain and label past the film seal means as film is first drawn from said positive film feed to rotate the roll and label in a first direction by said friction connection and film is then drawn from said demand film feed to rotate the roll and label in the opposite direction by said friction connection, and tensioning means maintaining said curtain taut during film feeding and forming of the envelope, whereby actuation of the film seal means forms a seal across the curtain closing a snug envelope on the roll and label with the label held in a known position in the envelope and a seal re-establishing the curtain.

12. The method of forming a snug transparent film envelope surrounding a roll with a flexible label non-rigid label wrapped between the envelope and roll and extending partially around the circumference of the roll comprising the steps of:

a. Maintaining a taut transparent film curtain extending across a work area in the path of movement of a roll;

b. Gripping a flexible non-rigid label at a label pickup position remote from the work area and moving the gripped label to a position in front of the curtain and in the path of movement of a roll toward the curtain, and releasing the label at the position in front of the curtain, the label having a circumferential extent when on the roll less than the circumference of the roll;

c. Moving the roll against the label and curtain to form a frictional connection between the roll and curtain, capture the label between the roll and the curtain, and fold the curtain and label around the roll;

d. Moving the roll, folded curtain and label past sealing means while first supplying a measured length of film to one side of the curtain to rotate the roll and label in a first direction by said frictional connection and then demand supplying sufficient film to the other side of the curtain to rotate the roll and label in the opposite direction by said frictional connection to complete a snug envelope around the roll and position the label in a known position in the envelope; and e. Actuating the sealing means to close the folded, taut curtain about the roll and form a sealed, snug transparent envelope confining the label in place on the roll and reform the curtain.

13. The method of claim 12 including the step of imparting zero net rotation to the roll during film feeding.

14. The method of claim 12 including the step of imparting a net rotation to the roll in one direction during film feeding.

15. The method of claim 12 including the step of locating the label edges away from the seal closing the envelope.

16. The method of claim 15 including the step of locating the label edges approximately equidistant from the seal closing the envelope.

* * * * *

UNITED STATES PATENT OFFICE

CERTIFICATE OF CORRECTION

PATENT NO. : 4,423,584

DATED : January 3, 1984

INVENTOR(S) : Bertram F. Elsner et al

It is certified that error appears in the above-identified patent and that said Letters Patent are hereby corrected as shown below:

Claim 12, column 11, line 10 delete "label".

Signed and Sealed this

*Twenty-seventh* Day of *March 1984*

[SEAL]

*Attest:*

GERALD J. MOSSINGHOFF

*Attesting Officer*

*Commissioner of Patents and Trademarks*